US006609445B2

(12) United States Patent
Elmore

(10) Patent No.: US 6,609,445 B2
(45) Date of Patent: Aug. 26, 2003

(54) SOCKET FOR A PIPE LINE VALVE

(76) Inventor: Dennis Elmore, 107 Boca de la Playa, San Clemente, CA (US) 92672

( * ) Notice: Subject to any disclaimer, the term of this patent is extended or adjusted under 35 U.S.C. 154(b) by 0 days.

(21) Appl. No.: 09/885,177

(22) Filed: Jun. 21, 2001

(65) Prior Publication Data

US 2002/0194966 A1 Dec. 26, 2002

(51) Int. Cl.[7] ..... B25B 13/00
(52) U.S. Cl. ..... 81/124.2; 81/176.15
(58) Field of Search ..... 81/124.2, 124.3, 81/176.1, 176.15, 176.2, 125, 121.1

(56) References Cited

U.S. PATENT DOCUMENTS 4,016,783 A * 4/1977 Spector et al. ..... 81/125
4,823,650 A * 4/1989 Tuttle ..... 81/176.15
5,199,333 A * 4/1993 Snyder, Jr. ..... 81/124.3
5,862,721 A * 1/1999 Kowats ..... 81/121.1
6,062,110 A * 5/2000 Julio et al. ..... 81/124.2
6,360,634 B1 * 3/2002 Leitch ..... 81/125

* cited by examiner

*Primary Examiner*—James G. Smith
(74) *Attorney, Agent, or Firm*—Chris Papageorge

(57) ABSTRACT

A socket designed for manually siding onto a valve adapted for use in a pipe line and enabling rotational movement of the valve and thereby connection to and disconnection from the pipe line. The socket has a square drive bore at a longitudinal end thereof to enable a square drive of a wrench to be inserted therein for rotation thereof. The recess of the socket is open box shaped and dimensioned to fit snugly around the outer surfaces of the valve for snug engagement of the valve to provide rotation of the valve via rotation of the socket. The socket also has semicircular openings at opposing lateral portions thereof to receive control and mounting structures of a ball valve structure therein and fit snugly therearound to provide more positive engagement of the valve. The inner walls of the socket are flat to fit snugly against corresponding flat surfaces of the valve to provide more positive engagement of the valve. In addition, the socket is provided with a post at an inner surface end portion thereof which fits within a pipe fitting at an end of the valve to provide a firm and stable fit of the socket on the valve.

3 Claims, 5 Drawing Sheets

SOCKET FOR A PIPE LINE VALVE

BACKGROUND OF THE INVENTION

The invention relates to means for connecting and disconnecting valves to and from pipe lines, and, more particularly, to structural means for such connecting and disconnecting of pipe line valves to and from water carrying pipe lines embedded underground.

Pipe lines which carry water to residential and commercial buildings incorporate valves which are used to control the water flow into each particular building. These valves which are referred to as corporation stops typically interconnect the water line going directly into the building with the water pipe line coming from the water main line. The interconnected pipe lines are typically one inch or three-quarters of an inch in diameter. Corporation stop valves and pipe lines are typically buried approximately one and one-half feet below ground surface which renders them relatively invulnerable to damage due to pedestrian and other types of traffic. However, their underground location requires persons attempting to repair or replace the valve or adjacent lines to dig a trench to provide access to the valve and pipe lines. The depth of the trench makes it difficult to attach a pipe wrench to opposing flat faces of the valve and rotate the valve ninety degrees to provide wrench access to the other opposing flat faces of the valve due to the necessary narrowness of the trench blocking large rotational movements of the wrench. This difficulty is exacerbated by corrosion of the threads of the valve and pipe due to being in a relatively moist underground environment for long periods. Use of wrenches with jaws that can provide clamping force on the valve is not practical because of the high likelihood of damage to the valve threads and body if such wrenches are placed on the valve at other than the flat faces thereof. In addition, the use of tapered pipe threads at the main line end of the valve requires the application of high torque to rotate the valve and thereby connect the valve to and disconnect the valve from the pipe line. The requirement of high torque makes the use of jaw type clamping wrenches impractical if used on other than the flat faces of the valve because such wrenches cannot maintain their grip on the valve under such high torque. Also, the application of high torque is very difficult in the cramped area of the very narrow trench when using an ordinary pipe wrench or adjustable wrench. Consequently, the task of repairing or replacing the valve and/or adjacent pipes is very time consuming and can result in extensive damage to the valve and the pipes. In addition, these difficulties can result in poor connections at the valve producing leaks and shortening the service life of the valve and pipes.

Many prior art wrenches and wrench fittings have been designed especially for plumbing and other pipe line fittings and attachments. An example of such a wrench designed especially for a plumbing valve is disclosed in U.S. Pat. No. 4,016,783 to Spector. The Spector wrench is specifically designed to eliminate the necessity of attaching an ordinary wrench directly to the plumbing valve and thereby eliminate the unsightly teeth marks and wear marks produced by attachment of such ordinary wrenches. The Spector wrench has a housing which partly encloses the valve and has an opening at one end thereof which fits around part of the pipe end of the valve for secure positioning thereon. The wrench housing is held in position on the valve by means of a stabilizer bolt attaching it directly to the valve. A wrench drive hole is provided at another end of the housing for receiving a wrench drive therein thereby enabling a ratchet wrench or the like to be used to rotate the housing and thereby the valve. The Spector wrench is a marked improvement over the use of conventional jaw type wrenches. However, a major disadvantage of the Spector wrench is that it is specially designed for angle valves, tees and elbows and thus cannot be used for corporation stops as well as many other types of pipe valves and fittings. In addition, the Spector wrench requires the use of a bolt to attach the housing to the angle valve and thus limits such wrenches to use on structures which are produced with such bolt holes or which may be provided with such bolt holes. Moreover, attachment of such a bolt may be time consuming and may be impractical due to the necessity of working in cramped quarters or inaccessibility of the bolt hole area.

Other prior art tools have been designed to facilitate the operation of plumbing fixtures. An example of such a tool is disclosed in U.S. Pat. No. 5,862,721 to Kowats. The Kowats patent discloses a socket type of tool having an oval shaped recess which is dimensioned to fit on and around a faucet handle to securely grip the faucet thereby. The Kowats socket has a drive hole and an hexagonal head at an end thereof to enable engagement thereof by a suitable wrench. The Kowats socket thus enables improved leverage to be applied to the faucet handle and thereby facilitates operation thereof. A desirable feature of the Kowats socket is that it may be easily manually placed on and removed from the faucet handle. However, a primary disadvantage of such a socket design is that it does not have a means for securing the socket in the desired position on the handle to preclude cocking thereof. In addition, this design cannot be used on plumbing structures other than faucet handles of a particular shape and size.

A tool is thus needed that can be fitted onto a corporation stop type valve and facilitate rotation thereof. Such a tool is needed that is adapted for engagement by a ratchet wrench so that it can allow rotation of the valve thereby in a narrow and confined area of a ground trench which are typically used since they are the most pragmatic means for providing access to the valve and pipe lines. Such a socket is also needed that can positively and securely engage the valve by simply manually fitting it thereon without the necessity of special tools.

SUMMARY OF THE INVENTION

It is a principal object of the present invention to provide a tool which allows the application of high torque thereby in a narrowly confined area in connecting and disconnecting a pipe valve to and from pipe lines.

It is also an object of the present invention to provide a tool which can be manually fitted onto a pipe valve for connection and disconnection thereof.

It is an object of the present invention to provide a tool which can be manually removed from a pipe valve after use for connection and disconnection of the valve.

It is an object of the present invention to provide a tool which securely and firmly fits onto the valve.

It is an object of the present invention to provide a tool which is shaped and sized to snugly fit against and around a pipe valve for positive engagement thereof so that the tool can provide more effective rotation of the valve.

It is an object of the present invention to provide a tool which has openings at lateral portions thereof so that it can accomodate valve structures protruding from the main body of the valve.

It is an object of the present invention to provide a tool which includes a structure which fits inside a pipe end of a pipe valve to prevent undesired lateral movement of the tool relative to the valve when used to rotate the valve.

It is an object of the present invention to provide a tool having a wrench drive bore at an end thereof to enable use of a ratchet wrench thereon to connect and disconnect a pipe valve to and from pipe lines.

It is an object of the present invention to provide a tool for connection and disconnection of a pipe valve to and from pipe lines which is simple in construction for inexpensive manufacture thereof.

Basically, the tool of the present invention enables rotational connection and disconnection of a pipe structure situated in very cramped working quarters. The tool of the present invention is a socket having a recess which is shaped and sized to fit around most of a pipe valve. A standard sized valve used in water piping i.e., a corporation stop valve, is approximately square at a medial portion thereof with large flat surfaces at a pair of opposing lateral portions thereof. In order to accomodate such a standard sized valve, the tool consequently is provided with two large flat surfaces at corresponding opposing lateral portions thereof to snugly fit against these valve flat surfaces. The snugly fitting flat surfaces prevent the socket from rotating over the outer surfaces of the valve and thus prevent relative rotation between the socket and the valve. Consequently, when properly fitted onto the valve, rotation of the socket effectuates rotation of the valve.

A corporation stop valve has pipe fittings at both opposing ends thereof. One of the pipe fittings is adapted for connection to the water pipe line coming from the main line while the other of the pipe fittings is adapted for connection to the water pipe line leading to the residential or commercial building. The pipe fitting for the line leading to the building is designed so that the connection utilizes a gasket between the fitting and the line. Thus, this connection does not require high torque to prevent leaks and may therefore be installed and removed by means of an ordinary adjustable wrench which therefore does not need to provide high leverage. Consequently, the socket of the present invention which affords the capability of enabling the application of high torque cannot be utilized to full advantage in connecting or disconnecting the valve to and from the building line.

But, a corporation stop valve has a pipe fitting at the other end thereof which is adapted for connection to the water main pipe line and this pipe fitting is different than the building line fitting in that it utilizes tapered pipe threads. No gasket is used between the pipe fitting on the valve and the pipe line leading to the water main. Thus, this connection must be made with high torque in order to provide a leak proof seal. Consequently, the socket of the present invention which affords the capability of enabling application of high torque can be utilized to full advantage in connecting and disconnecting the valve to and from the pipe line leading to the water main.

Since the pipe lines in the area of the corporation stop valves are commonly situated underground approximately one and one-half feet below the ground surface, a trench usually must be dug to provide access to the valve and pipe lines for connection or disconnection thereof. Such trenches are commonly made rather narrow due to the undue amount of labor required to dig a wide trench. Moreover, digging a wide trench would unreasonably disrupt or damage a relatively large area of the environment which may be a garden, front lawn, patio or the like and thus unacceptable due to the labor and expense required to restore the area to its former condition. But, high torque at this type of valve connection requires the use of a long wrench for providing high leverage. However, the narrowness of the trench and its depth severely limits rotational movements of the wrench such that its arc of rotation is very small. In addition, the best locations for connection of the jaws of the wrench are at the opposing lateral flat faces of the valve. But, this requires that the valve be rotated about one-hundred and eighty degrees in order to enable the jaws of the wrench to regrip the valve for further rotation. But, pragmatically, this cannot be accomplished using a long wrench in a narrow trench. Alternatively, using a pipe wrench to rotate the valve relative to the pipe line is likely to leave teeth marks and wear away part of the valve face or threads thereby producing unacceptable wear thereon. In addition, using a pipe wrench is unlikely to provide a sufficiently good grip on any portion of the valve other than the opposing flat surfaces. Thus, use of a pipe wrench is likely to be ineffective and just result in damage to the valve.

The socket is provided with a bore to receive a ratchet wrench drive therein. The drive bore is located at an end of the socket. The bore is also located and oriented so that it is in line with the axis of the socket. The drive bore allows a user to easily attach a ratchet wrench to the socket either before or after the socket is installed on the valve and apply the desired amount of torque thereby to rotation of the valve. The ratchet wrench also allows rotation of the valve in relatively small increments thereby allowing the wrench movements to stay within the confines of the trench. The unique socket thus facilitates connection and disconnection of the valve while preventing damage to the valve that might otherwise occur with conventional tools.

The socket of the present invention has an open box shape that allows it to be quickly and easily slipped onto the pipe valve and moved into the proper position for effectuating rotation of the valve thereby. The socket does not require any bolt or screw structures to secure the socket onto the valve so the installation of the socket is relatively quick, simple and easy. Another important feature is that the installation of the socket on the valve does not require any tools but instead can be accomplished entirely by hand. This is especially advantageous in the cramped, confined and inadequately lit quarters of a typical trench dug for access to the valve which can make the prolonged use of some tools awkward, difficult and unduly time consuming.

DETAILED DESCRIPTION OF THE PREFERRED EMBODIMENT

Figure 1:
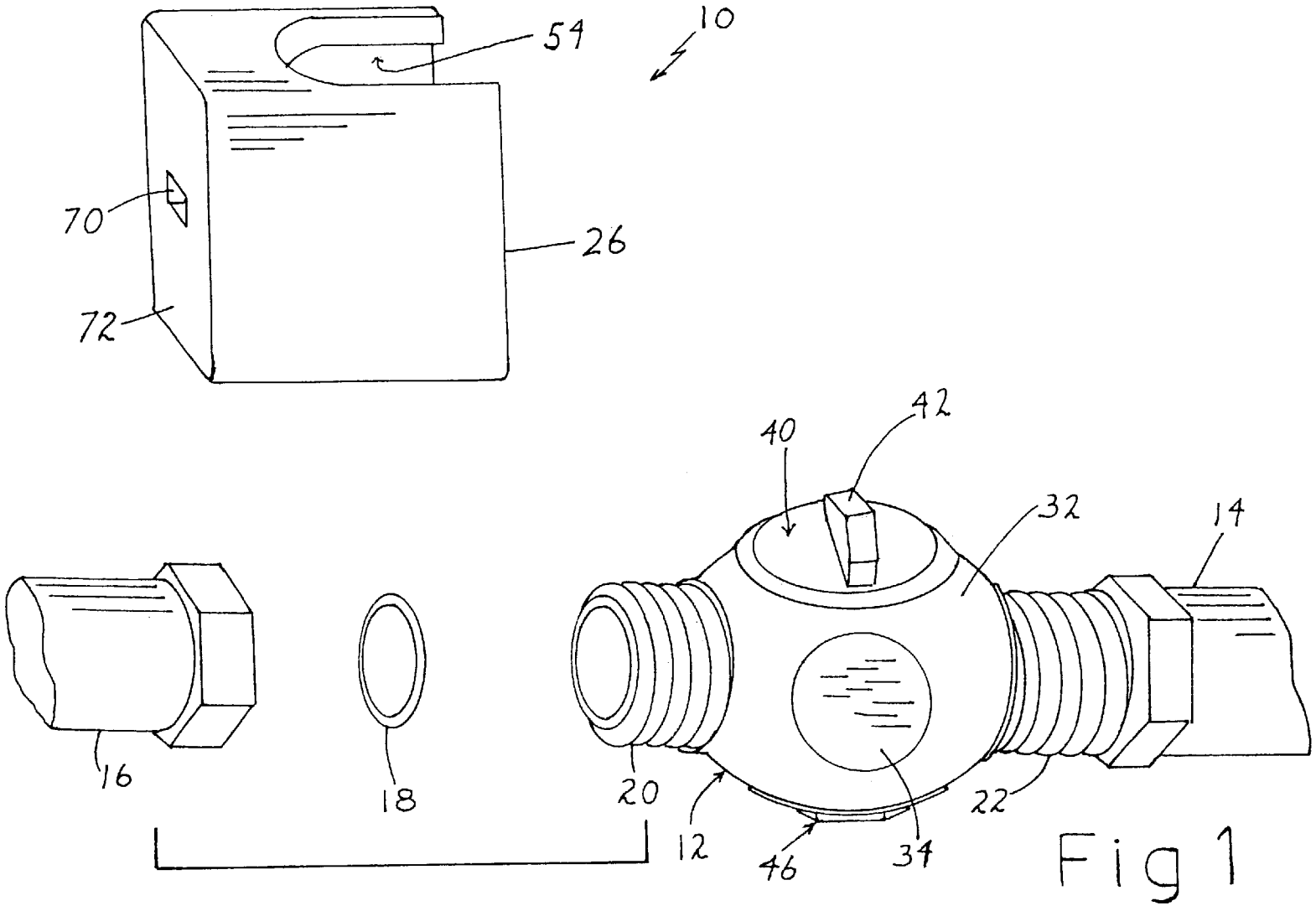
FIG. 1 is a perspective view of the socket of the invention also showing a partially exploded view of a pipe line valve to which it is to be attached.

Referring to the drawings, the socket of the present invention is generally designated by the numeral 10. The socket 10 is particularly designed to be used with a pipe line valve (or corporation stop valve) 12 which connects a pipe line 14 coming from a water main to a pipe line 16 leading to a residential building (or commercial building or other type of end user structure). A typical pipe line valve 12 is shown connected to a typical water pipe line 14 in FIG. 1. But, the valve 12 is disconnected from the water pipe line 16 since it is not specifically required in the connection and/or disconnection of water pipe line 16. This is because a rubber gasket 18 is typically used in the interconnection between the pipe line 16 and the outlet end fitting 20. Use of the gasket enables this connection to be leak proof without necessitating the use of high torque in making this connection. Thus, a simple adjustable wrench may be used to connect the pipe line 16 and the fitting 20 and provide a leak proof joint. No special tool is ordinarily required to connect or disconnect the line 16 to and from the fitting 20. However, the connection between the pipe line 14 and inlet end fitting 22 is a pipe thread fitting with the end fitting 22 tapered to provide the requisite tight fit between the pipe line 14 and fitting 22. Thus, there is no gasket utilized in the connection between the end fitting 22 and the pipe line 14. Consequently, the connection between the fitting 22 and line 14 requires the application of high torque to provide the necessary high degree of tightness for a leak proof joint.

Figure 2:
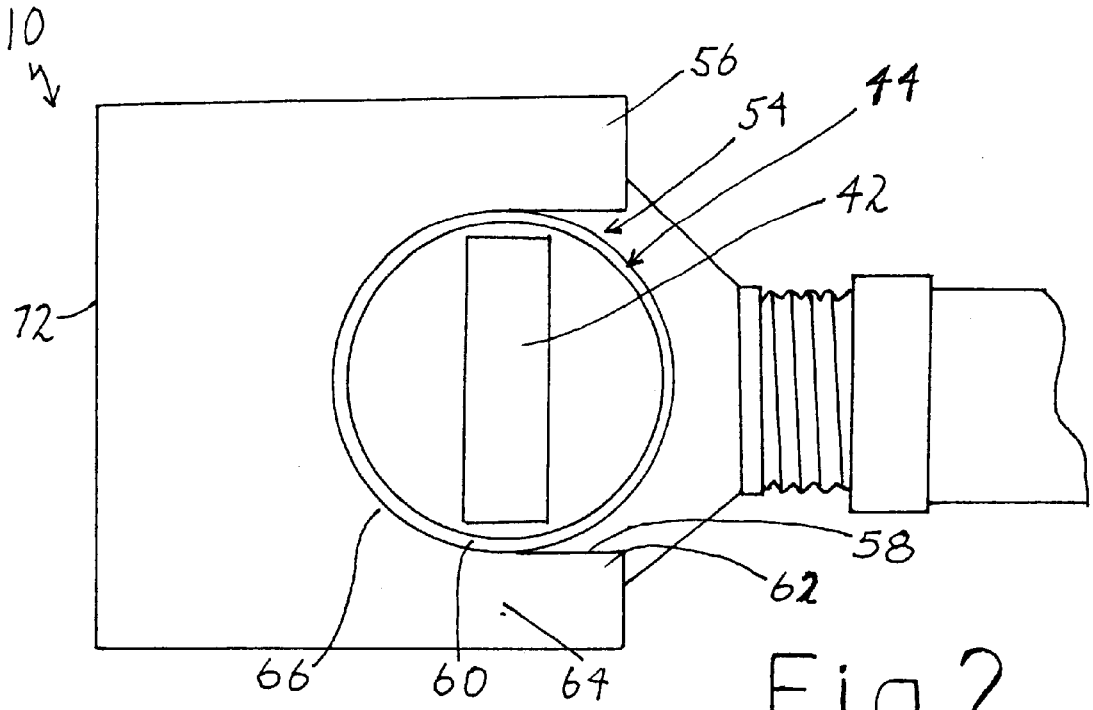
FIG. 2 is a side view of the socket of the invention shown installed on the valve.
Figure 3:
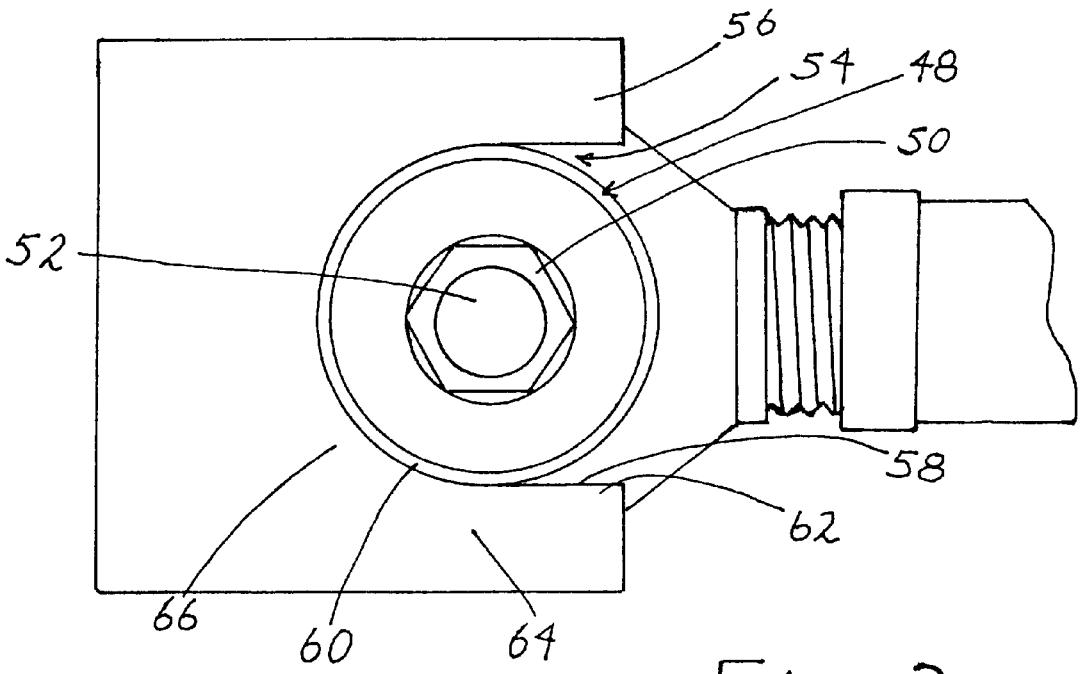
FIG. 3 is a top view of the socket of the invention shown installed on the valve.
Figure 4:
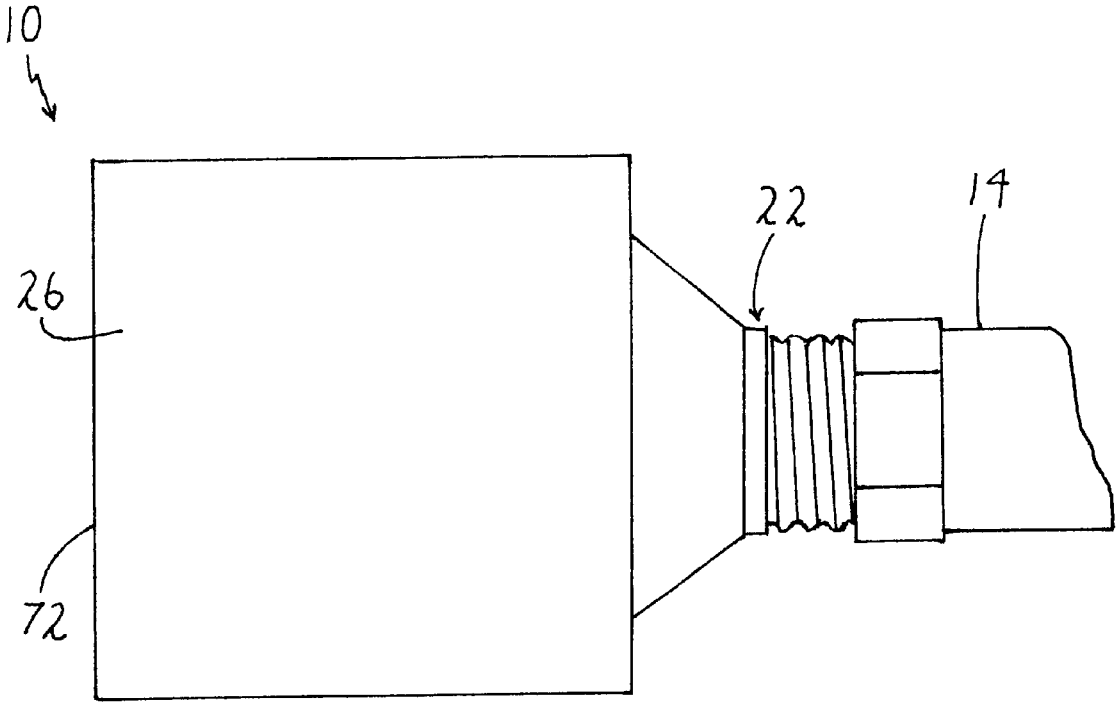
FIG. 4 is a bottom view of the socket of the invention shown installed on the valve.
Figure 5:
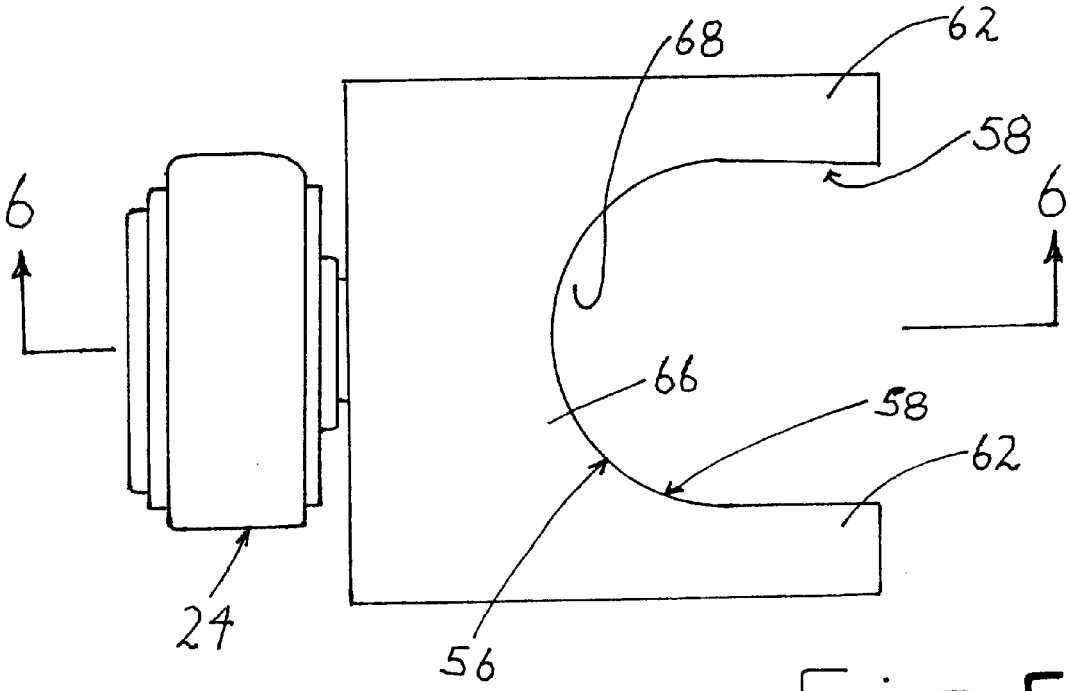
FIG. 5 is a side plan view of the socket of the invention depicting the inner structures thereof and shown with a ratchet wrench attached thereto.
Figure 6:
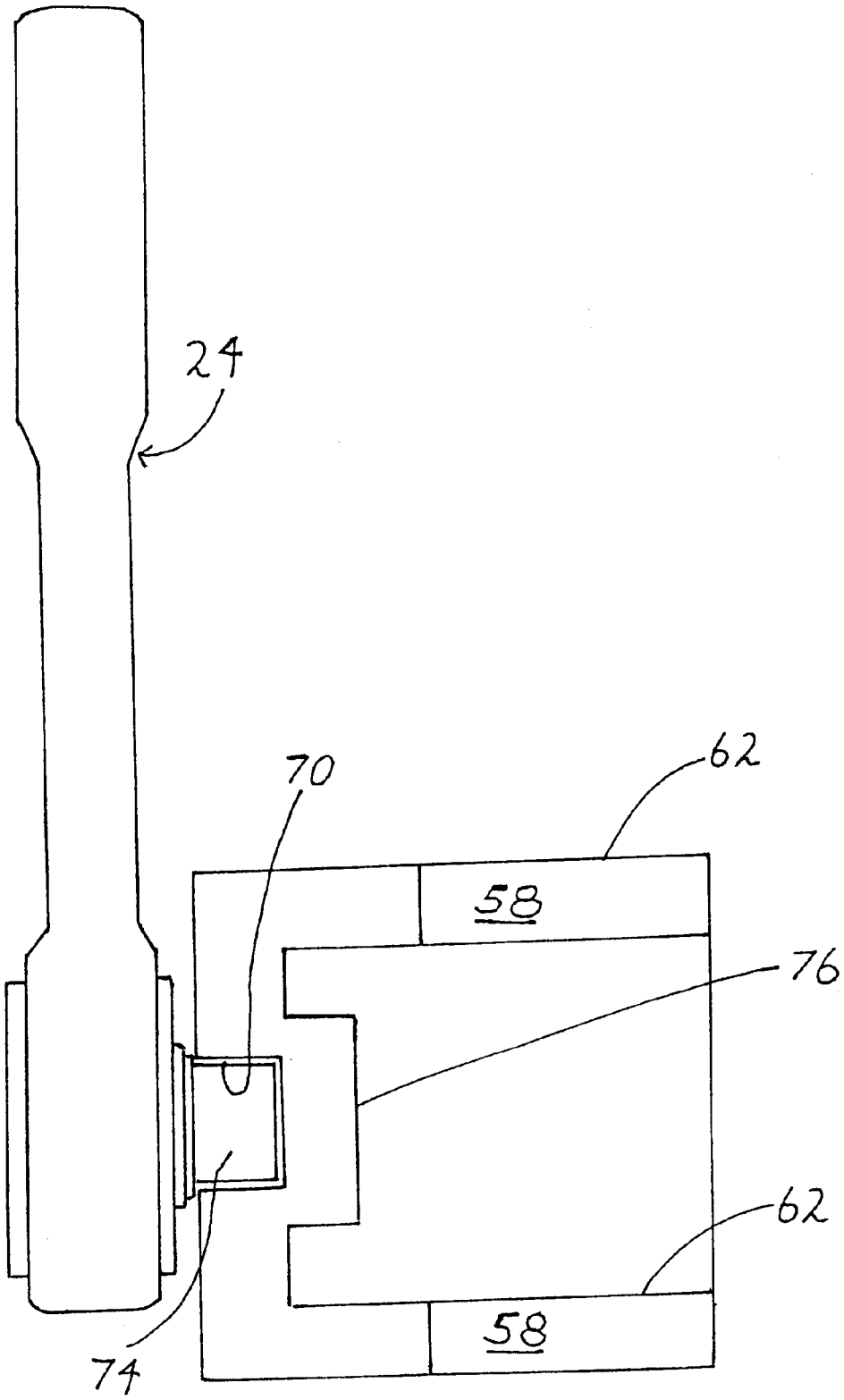
FIG. 6 is a sectional view of the socket of the invention taken along lines 6—6 of FIG. 5 and also showing the ratchet wrench attached thereto.
Figure 7:
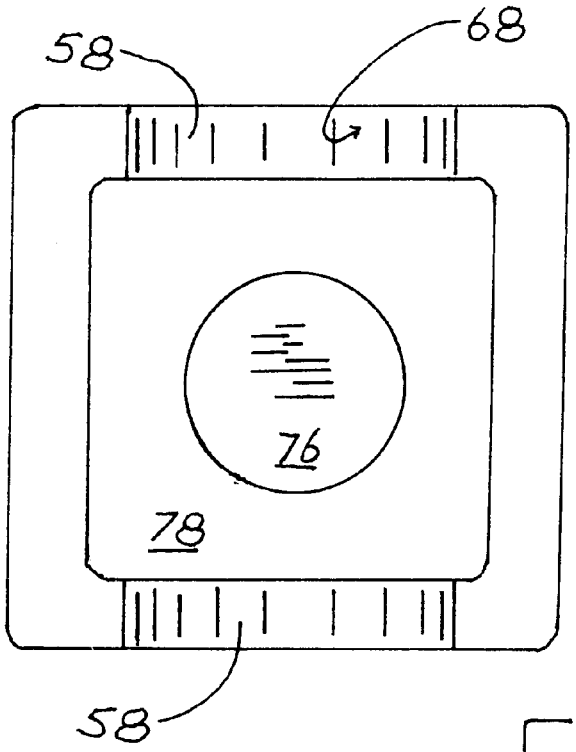
FIG. 7 is a plan view of the right end side of the socket of the invention showing the recess thereof.
Figure 8:
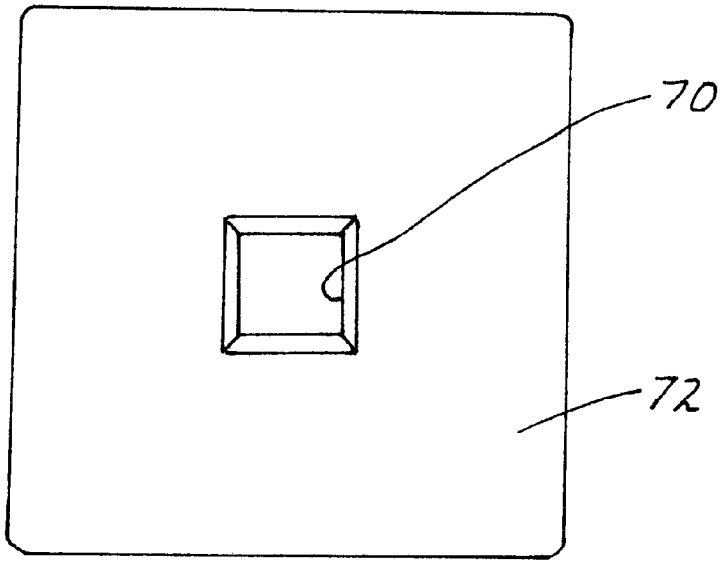
FIG. 8 is a plan view of the left end side of the socket of the invention showing the drive bore thereof.

A typical valve 10 when in use interconnecting pipe lines 14 and 16 is typically buried underground. Consequently, a trench (not shown) must typically be dug to provide access thereto for repair or replacement. But the trench provides very narrow working quarters making it impractical or impossible for a wrench which grips opposing flat surfaces of the valve to be rotated sufficiently to rotate the valve into a position in which it can grip other adjacent flat surface portions of the valve or regrip the same flat surface portions rotated one-hundred and eighty degrees. The socket 10 provides a means for gripping the valve and allowing the use of a ratchet wrench 24 on the socket 10 which can provide needed rotation of the socket together with the valve in the desired small increments so that the wrench handle can remain within the confines of the narrow trench. The socket 10 has a socket body 26 which is provided with a recess 28 and is generally open box shaped to facilitate slipping over and around the valve 12, as shown in FIGS. 2, 3 and 4. Since the valve body 26 at its medial portion 32 is generally square in cross-section, the recess 28 (and the socket body 26) is similarly square shaped in cross-section so that it can generally conform to the shape of the medial portion of the valve. Since the medial portion 32 has a pair of opposing large flat surfaces 34, the socket 10 is provided with corresponding inner walls 36 with large flat surfaces 38. These opposing inner walls 36 are spaced apart a distance selected to enable them to be closely adjacent the valve flat surfaces 34 for a desired snug fit thereagainst. The height and longitudinal length of the inner walls 36 are selected so that the flat surfaces 38 cover generally all of the flat surfaces 34 when the socket 10 is installed on the valve 12. This provides enhanced positive engagement of the valve 12 by the socket 10 and, more specifically, by the inner walls 36 of the recess 28 of the socket 10.

A typical corporation stop type pipe valve is provided with a ball valve structure 40 at its inside portion. The ball valve structure 40 has a control or handle 42 located at a face 44 of the valve body 26 which enables the valve 12 to be manually opened and closed. The ball valve structure 40 also has a mounting or securement structure 46 located at another face 48 of the valve body. The face 44 at which the securement structure 46 is located is situated opposite to the face 48 at which the handle 42 is located. As shown in FIGS. 1 and 2, the handle 42 protrudes a little from the valve body 26 and the securement structure 46 includes a nut 50 and stem 52 which both protrude a little from the valve body 26. The handle 42 is typically round and the nut 50 is typically hexagonal. Therefore, in order to provide a snug fit around the valve body 26, the socket 10 is provided with cut out portions 54 which are preferably semicircular and are open at longitudinal ends 56 thereof so that when the socket is slipped over the valve body 26 the semicircular (or cut out) portions 54 fit around most of the lateral portions of the handle 42 and nut 50 (and stem 52). This enables the inner surface portions 58 (which are flat) surrounding the semicircular portions 54 to cover the remaining flat surfaces 60 of the faces 44 and 48 which are adjacent to and surround the securement structure 46 and handle 42. The semicircular portions 54 also preferably include straight end portions 62 at the ends 64 of the arc portions 66 of the semicircular portions 54. The semicircular portions 54 in conjunction with the straight portions 62 define semicircular openings 68 which receive the handle and securement structures 42 and 46. The straight portions 62 extend longitudinally from the ends 64 of the arc portions 66 and enable the socket 10 to extend over and cover a larger portion of the valve body 26 in order that the socket 10 more fully and firmly engages the valve body 26. Thus, the enhanced positive engagement of the socket 10 on the valve 12 enables rotation of the socket 10 to more firmly and reliably produce simultaneous rotation of the valve 12. The semicircular openings 68 are preferably identical in size so that the socket can be fitted onto the valve 12 in either of two rotational positions thereon. These rotational positions are separated by one-half turn or one-hundred and eighty degrees of rotation of the socket 10.

The socket 10 is provided with a wrench drive bore 70 at a longitudinal end portion 72 of the socket 10. The end portion 72 is preferably generally closed except for the drive bore 70. The drive bore 70 is preferably a square drive bore and preferably one-half inch drive although it may also be any other suitable size. The drive bore 70 receives the wrench drive 74 of the ratchet wrench 24 therein enabling the wrench 24 to connect to and be used to rotate the socket 10 and valve 12. The drive bore is preferably blind sided at an inner end thereof. The drive bore 70 is preferably chamfered at an outer end thereof to facilitate installation of the wrench drive 74 thereon. The drive bore 70 is preferably in alignment with the longitudinal axis of the socket 10 so that the wrench can produce the desired rotation thereof. Instead of a ratchet wrench, a breaker bar or any other suitable type of tool may be used to effectuate rotation of the socket 10 and valve 12.

The socket body 26 has a post 76 located at the end portion 72 at the inner surface 78 thereof. The post 76 projects inwardly from the inner surface 78. The post 76 is preferably circular in cross-section so that it can conform to the shape of the outlet end fitting 20. The post 76 is also preferably slightly smaller in diameter than the inside diameter of the end fitting 20 so that the post can snugly fit inside the end fitting 20 when the socket 10 is fitted onto and around the valve 12. Thus, the post 76 provides a more secure, more stable and more firm fit of the socket 10 on the valve 12 to minimize or eliminate wobbling or slippage of the socket 10 on the valve 12 during rotation thereof.

The outer dimensions of the socket 10 are preferably three by three by three inches. The inner dimensions of the socket 10 i.e., the recess 28, are preferably two and three-sixteenths by two and three-sixteenths inches with a depth of two and one-half inches. These dimensions are selected to enable the socket 10 to fit onto a standard sized one inch corporation stop valve. However, the socket may also be manufactured with other dimensions to accomodate a three-quarter inch corporation stop valve or any other suitable pipe valve.

The socket 10 is preferably composed of a metal such as aluminum in order to provide rigidity and structural strength. However, socket 10 may also be composed of steel or another suitable type of metal. In addition, socket may be composed of plastic or any other suitable type of material. The inner surfaces of the socket 10 preferably are also provided with a smooth finish to facilitate sliding the socket 10 onto the valve 12.

Accordingly, there has been provided, in accordance with the invention, a socket for fitting onto a pipe valve to enable connection and disconnection of the valve from pipe lines. It is to be understood that all the terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include such alternative embodiments, modifications and variations that fall within the spirit and scope of the invention as set forth in the claims hereinbelow.

What is claimed is:

1. A socket for a valve having threaded fittings at opposite ends thereof, comprising a body having a wrench drive bore for receiving a wrench drive therein to allow rotation of the socket thereby and having inner walls defining a recess for removably enclosing lateral portions of the valve, said inner walls shaped to engage lateral surface portions of the valve to enable rotation of the socket to result in rotation of the valve for connection and disconnection of the valve to and from a line, one of said inner walls including a post projecting into the recess for fitting into a pipe fitting at an end of the valve to enhance positive engagement of the socket onto the valve.

2. The socket of claim 1 wherein said post is circular in cross-section to accomodate circular cross-sectional shape of the pipe fitting.

3. The socket of claim 1 wherein said post is located at an inner end of the drive hole.

* * * * *